US005244409A

United States Patent [19]

Guss, III et al.

[11] Patent Number: 5,244,409

[45] Date of Patent: Sep. 14, 1993

[54] MOLDED CONNECTOR WITH EMBEDDED INDICATORS

[75] Inventors: Robert J. Guss, III, Glen Ellyn; John T. Fleckenstein, Lake Forest; Ronald J. LeClair, Barrington, all of Ill.

[73] Assignee: Woodhead Industries, Inc., Northbrook, Ill.

[21] Appl. No.: 726,719

[22] Filed: Jul. 1, 1991

Related U.S. Application Data

[63] Continuation of Ser. No. 551,870, Jul. 12, 1990, abandoned.

[51] Int. Cl.[5] ..... H01R 3/00

[52] U.S. Cl. ..... 439/490; 439/736

[58] Field of Search ..... 439/488–491, 439/650–655; 340/656, 664, 687

[56] References Cited

U.S. PATENT DOCUMENTS

| | | | |
|---|---|---|---|
| 3,065,335 | 11/1962 | Madansky | 439/547 |
| 3,500,293 | 3/1970 | Cocco | 439/490 |
| 3,942,859 | 3/1976 | Korodi | 439/490 |
| 4,101,190 | 7/1978 | Schoff | 439/490 |
| 4,484,185 | 11/1984 | Graves | 439/490 |
| 4,500,160 | 2/1985 | Bertsch | 439/490 |
| 4,659,161 | 4/1987 | Holcomb | 439/490 |

FOREIGN PATENT DOCUMENTS

| | | | |
|---|---|---|---|
| 920250 | 1/1973 | Canada | 439/490 |

*Primary Examiner*—David L. Pirlot
*Attorney, Agent, or Firm*—Emrich & Dithmar

[57] ABSTRACT

A quick-disconnect connector assembly for connecting a control device or a sensor to a load includes a power/-load indicating circuit having a source of red light for indicating that power is available and a source of green light for indicating that power is being applied to a load, the indicating circuit being encapsulated within a molded connector head which is formed of a translucent material so that light emitted by the red and green light sources causes the connector head to glow over substantially its entire extent.

15 Claims, 1 Drawing Sheet

MOLDED CONNECTOR WITH EMBEDDED INDICATORS

This is a continuation application of Ser. No. 07/551,870, filed Jul. 12, 1990 now abandoned.

BACKGROUND OF THE INVENTION

This invention relates to quick-disconnect connector assemblies, and more particularly to a condition-indicating lighted electrical connector assembly for connecting a control or monitoring device to a load.

There are many applications in which quick-disconnect type connectors are used to establish connections between electrical power lines and a load, typically by interfacing sensors and other control components with the power lines and load. For example, in industrial applications, such connectors may be used for wiring control circuit applications, such as pilot-actuated hydraulic valves or conveyor system controls, or for power circuit applications, such as the control of fractional horsepower motors or heaters. The quick-disconnect type connectors provide error-free connection of multi-wire systems in a fraction of the time required to hardwire or to establish a semipermanent connection as by soldering or using screws and terminal blocks.

It is commonplace to have connectors with two, three, four or even more poles. For example, in the case of a load, such as a machine, being connected by means of a multi-wire cable to a controller, two wires may be used to connect a source of electrical power to the machine; one or more additional wires may be used to establish a control function from a controller to the machine; and one or more additional wires may be used to establish a sensing function at the machine.

More specifically, the quick-disconnect connector may be used to connect a control device, such as a proximity switch, in series with electrical power lines and the load, the control device controlling the application of electrical power to the load. In such application, it is generally desirable to indicate conditions, such as when power is available for application to the load. It may also be desired to indicate when power is being applied to the load—i.e., the control device or switch is turned "on". Connectors which provide these functions are known as "lighted connectors". Lighted connectors which are presently available include one or more neon indicating lamps (or light-emitting diodes) mounted within a connector housing which has internal terminating elements to which are connected the electrical wires of the cable. The housing has windows or apertures therethrough and the neon lamps (or LEDs) are located adjacent to the windows to be visible from the exterior of the connector. In use, the neon lamps are lit to indicate conditions, such as the availability of electrical power, and energization of the load.

Although these "lighted connectors" provide the desired indications of power and load status, connectors of this type require manufacturing the connector with apertures to permit viewing of the neon lamps. Also during assembly, the neon lamps must be mounted adjacent to the apertures through which they are exposed. Moreover, because the on/off condition of the neon indicator lamps is provided only on the one side of the connector, it may be difficult for a user to quickly determine whether or not power is being applied to the load.

Another consideration is that such connectors are frequently used in environmental conditions which require sealing against moisture, dust and chemicals. Thus, molded connector heads are frequently used. In known connectors, such molded connector heads are opaque and thus will not transmit light to the exterior of the connector head.

SUMMARY OF THE INVENTION

The present invention provides a quick-disconnect connector assembly for completing an electrical circuit to connect a functional device to a load and for indicating a continuity condition for the electrical circuit. The connector assembly includes connecting means including a connector body and a molded connector head, a multi-conductor cable including a plurality of electrical conductors, and indicating circuit means including at least one light source energizable for indicating the continuity condition.

The connector body has first and second ends and a plurality of terminating elements extending therethrough between the first and second ends. At least first and second ones of the conductors are electrically connected to first and second ones of the terminating elements at the first end of the connector body. The indicating circuit means is electrically connected to conductors of the multi-conductor cable adjacent to the first end of the connector body, to enable the light source to be energized when the continuity condition is provided. The molded connector head encloses the first end of the connector body and the indicating circuit means. The molded connector head is translucent whereby light produced by the light source embedded within the connector head causes the molded connector head to glow whenever the continuity condition is provided.

The invention consists of certain novel features and structural details hereinafter fully described, illustrated in the accompanying drawings, and particularly pointed out in the appended claims, it being understood that various changes in the details may be made without departing from the spirit, or sacrificing any of the advantages of the present invention.

DESCRIPTION OF THE DRAWINGS

For the purpose of facilitating and understanding the invention, there is illustrated in the accompanying drawings a preferred embodiment thereof, from an inspection of which, when considered in connection with the following description, the invention, its construction and operation, and many of its advantages will be readily understood and appreciated.

DESCRIPTION OF PREFERRED EMBODIMENTS

Figure 1:
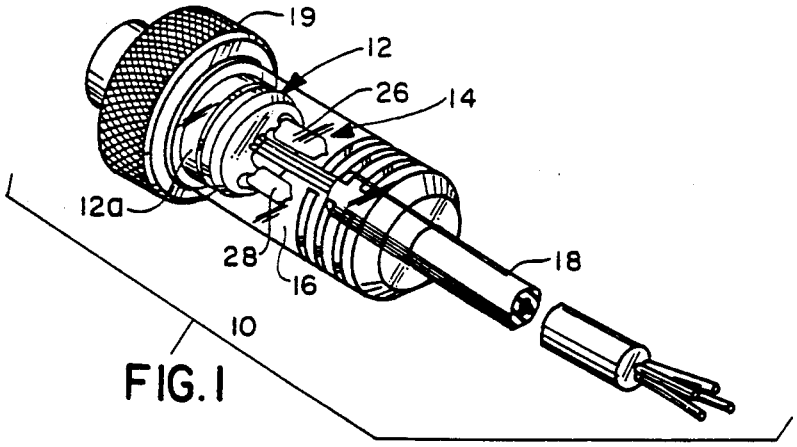
FIG. 1 is a perspective view of a quick-disconnect connector assembly provided by the present invention.
Figure 2:
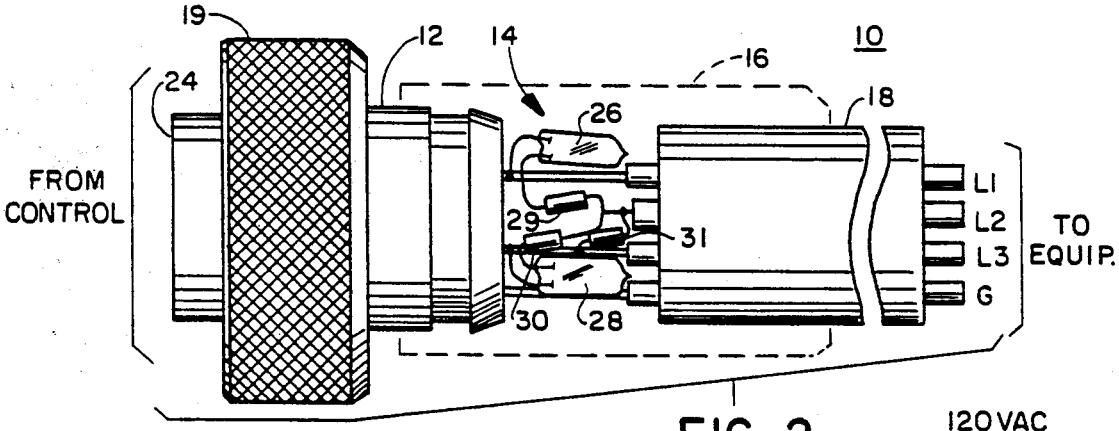
FIG. 2 is an enlarged plan view of the quick-disconnect connector assembly with the molded connector head represented in simplified form by a dashed line to illustrate the details of the indicating circuit of the connector assembly.
Figure 4:
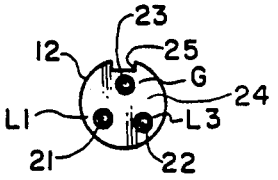
FIG. 4 is a face view of the connector body.

Referring to FIGS. 1, 2 and 4 of the drawings, the quick-disconnect connector assembly provided by the present invention is indicated generally at 10. The connector assembly 10 includes a connector body portion or insert 12, an indicating circuit 14, a molded connector head 16 which encloses a portion of connector body 12 and the indicating circuit 14, and a multi-conductor cable 18. The connector assembly 10 also includes a coupling nut 19.

In the exemplary embodiment, the connector assembly 10 is a three pole connector and the multi-conductor cable 18 includes four conductors L1, L2, L3, and G. The length of the multi-conductor cable may be in the range of three to twelve feet, for example. The indicating circuit 14 includes two neon lamps 26 and 28. Alternatively, the light sources may be light-emitting diodes (LEDs). As will be shown, in use, the connector assembly 10 is so connected with power conductors, a load, and a functional device such as a control device or sensor, that one of the lamps 26 is energized whenever power is available, and the other neon lamp 28 is energized whenever power is applied to the load.

In accordance with a feature of the invention, the two neon lamps 26 and 28 produce different colored light. For example, neon lamp 26, which indicates that power is available, is a source of red light. Neon lamp 28, which indicates that power is being supplied to the load, is a source of green light. Further, in accordance with the present invention, the molded connector head 16 is made of a material which is opaque or translucent rather than clear or transparent, and therefore diffuses the light produced by the neon lamps 26 and 28 embedded in the connector head to impart a soft glow to the connector head 16 whenever either one of the neon lamps 26 or 28 is lit. Thus, a user is quickly alerted as to "power available" and "power on" conditions, by merely glancing in the direction of the connector head 16 and noting whether or not it is glowing, and the color of the connector head, be it red or green.

Considering the connector assembly 10 in more detail, with continued reference to FIGS. 1, 2 and 4, the connector body 12 is a generally cylindrical element which has three axial bores therethrough which hold three electrical connector elements or terminals 21, 22 and 23. The connector assembly 10 provides female-type connector elements, because commercially available control switches and sensors generally include male-type connector elements. The connector body portion 12 is made of an insulating material. As is shown in FIG. 4, the face 24 has a non-conducting key slot 25 of rectangular cross-section for indexing purposes.

Figure 3:
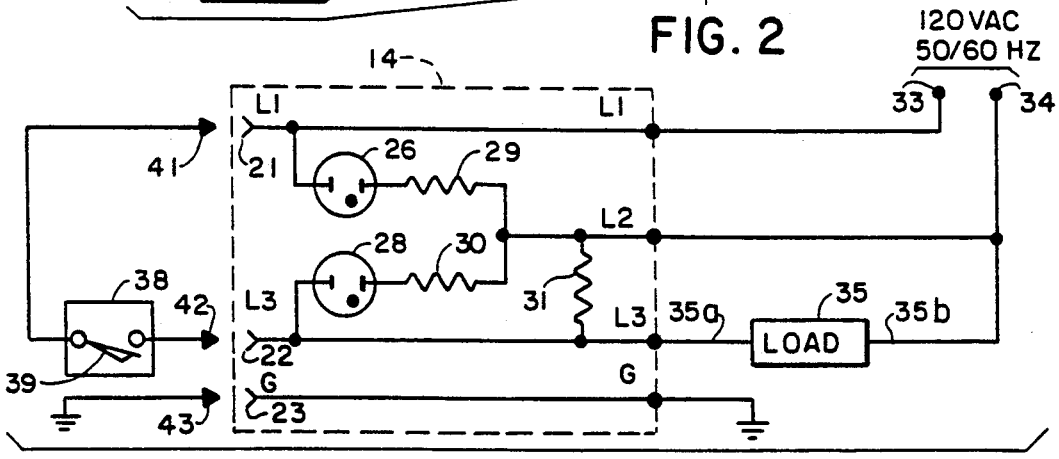
FIG. 3 is a schematic circuit diagram of the quick-disconnect connector assembly, illustrating an application for connecting a control device to a load for applying power to the load.

Referring to FIGS. 2 and 3, the indicating circuit 14 includes neon lamps 26 and 28 and resistors 29, 30 and 31. Neon lamp 26 is connected in series with current-limiting resistor 29 between conductors L1 and L2. Neon lamp 28 is connected in series with current-limiting resistor 30 between conductor L3 and conductor L2. Resistor 31 is a bleeding resistor connected between conductors L3 and L2. Conductor L1 is connected to the power hot line 33, conductor L2 is connected to the power neutral or return line 34 and conductor L3 is connected to one terminal 35*a* of a load 35 the other terminal 35*b* of which is connected to the neutral or return line 34. The fourth conductor G is connected to ground reference for the electrical power system.

Neon lamp 26 has a firing voltage of 90 volts AC and is lit whenever an AC voltage exceeding the firing voltage is available between power lines 33 and 34.

Similarly, neon lamp 28 has a firing voltage of 90 volts AC. Neon lamp 28 is lit whenever switch 38 is operated so that its switch arm 39 completes a circuit path between conductors L1 and L3, thereby extending power to the load terminal 35*a*, the other load terminal 35*b* being connected directly to the return power conductor 34.

The control device 38 is embodied as a switch having switch arm 39 connected between male connecting elements such as blades or prongs 41 and 42 which are receivable within female receptacles 21 and 22 (FIG. 4) of the connector assembly 10. A third male connecting element or prong 43 is connected to ground and is receivable by receptacle 23 (FIG. 4) of the connector assembly 10.

Resistor 31 is connected in parallel with the series circuit of light source 28 and resistor 30. In the case where the control device 38 is a solid state switch, there may be leakage current through it sufficient to cause lamp 28 to glow. The purpose of resistor 31 in such cases is to bleed off enough current so that insufficient voltage is generated across the lamp 28 to cause it to glow. In other words, the leakage current is prevented from causing the lamp to glow when the switch is in an "off" condition.

The molded connector head 16 encloses or encapsulates a portion 12*a* of the connector body 12 and the indicating circuit 14. Preferably the connector head 16 is made of a material which is translucent, but the molded connector head may be made of a transparent material. Consequently, the molded connector head diffuses the light from the neon lamps 26 and 28, so that a soft glow is imparted to the connector head 16 whenever either one of the neon lamps 26 or 28 is lit. However, because the connector head is not clear, but is slightly opaque, the components of the indicating circuit cannot be clearly distinguished through the molded connector head. By way of example, the connector head 16 is made of a polyvinyl chloride elastomer.

The coupling nut 19 is received on the connector body 12 and is internally threaded to secure its connection to a plug associated with a functional device, such as switch 38. A flange (not shown) on the outer surface of the connector body 12 prevents complete removal of the coupling nut 19 as is known in the art.

In use, conductors L1 and L2 are hardwired to the power input and return lines 33 and 34, respectively. Conductor L3 is connected to terminal 35*a* of the load 35 the other terminal 35*b* of which is hardwired to the return line 34. The ground lead G is hardwired to the power system ground.

A functional device such as proximity switch 38, having male-type prongs, is plugged into the female receptacle of the connector assembly 10 and secured in place by the coupling nut 19 which is screwed onto the threads of the connector housing for the proximity switch 38. The key slot 25 (FIG. 4) indexes with a key (not shown) on the mating plug to assure proper orientation of the plug relative to the connector assembly.

When power at 120 volts VAC is applied to power input terminals 33 and 34, this voltage is applied across conductors L1 and L2 causing neon lamp 26 to fire. When fired, neon lamp 26 imparts a soft red glow to the connector head 16, to indicate that power is available for the control device 38.

When the control device 38 is operated, a circuit path is completed through the switch 38 between conductors L1 and L3 of the connector, completing a circuit path for the load 35 between power input conductors 33 and 34. Accordingly, the load 35 is energized. Also, a voltage appears between conductors L3 and L2, causing neon lamp 28 to fire. When neon lamp 28 is fired, a green glow is imparted to the connector head 16 indicating that the load 35 is energized.

While in the exemplary embodiment, the connector assembly 10 is described as having an indicating circuit 14 which includes a pair of neon lamps 26 and 28 which provide separate indications of "power available" and "power on" conditions, it is apparent that a connector assembly may be provided that does not include neon lamp 28 and resistors 30 and 31 so that the indicating circuit indicates only a "power available" condition. Alternatively, a connector assembly may be provided that does not include neon lamp 26 and resistor 29 so that the indicating circuit 14 indicates only a "power on" condition. Bleeding resistor 31 is not necessary if the "power on" lamp 28 is not used.

Figure 5:
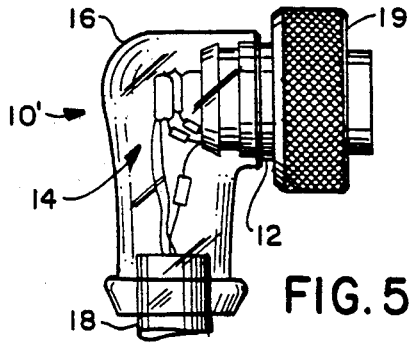
FIG. 5 is a side elevational view of a further embodiment for the quick-disconnect connector assembly which includes a 90° offset of the connector body relative to the multi-conductor cable.

Furthermore, although the connector assembly 10 illustrated in FIGS. 1–4 is a "straight" connector, it is apparent that the connector assembly may have a 90° offset, such as for the connector assembly 10' illustrated in FIG. 5, or at any offset angle between 0 and 90°. The connector assembly could be constructed and arranged to provide an adapter function, i.e., a male/female connector with the indicating circuit located to light the middle portion of the connector assembly. Moreover, although for purposes of illustration the connector assembly is described as being a three pole device and including a four-conductor cable, it is apparent that the connector assembly may have fewer or more poles and correspondingly fewer or more conductors and may be adapted to receive one or more control devices as well as one or more sensors, depending upon the application for the connector assembly.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

We claim:

1. A quick-disconnect connector assembly for completing an electrical circuit and for indicating a continuity condition for the electrical circuit, said connector assembly comprising:

connecting means including an insert carrying a plurality of connector elements;

a multi-conductor cable including a plurality of electrical conductors; and indicating circuit means including at least one light source energizable for indicating said continuity condition;

at least first and second conductors of said plurality of conductors being electrically connected to first and second ones of said terminating elements at said first end of said connector body, and said indicating circuit means being directly electrically connected to conductors of said multi-conductor cable adjacent to said first end of said connector body to enable said light source to be energized whenever the continuity condition is provided;

and a connector head molded to enclose said first end of said connector body and said indicating circuit means, and the adjacent end of said cable to provide strain relief between said insert and said cable and to provide a sealed housing for said indicating circuit and said connections between said cable and said connector elements of said insert;

said molded connector head being of a light-transmitting material moldable whereby light produced by said light source representative of a detected continuity condition of said electrical circuit is emitted through said molded connector head such that the status of said indicating circuit means may be observed from substantially all directions of normal use observation.

2. The connector assembly of claim 1 wherein said connector head consists of a translucent polyvinyl chloride elastomer.

3. The connector assembly of claim 2 wherein said light source of said indicating circuit means is so connected to conductors of said multi-conductor cable as to indicate that power is available for application to the load.

4. The connector assembly of claim 2 wherein said light source of said indicating circuit means is so connected to conductors of said multi-conductor cable as to indicate that power is being applied to the load.

5. The connector assembly of claim 4 wherein said functional device is a semiconductor switch, and further comprising a bleeding resistor connected in circuit with said light source such that leakage current in said device will not energize said light source when said device is in an off condition.

6. The connector assembly of claim 2 wherein said indicating circuit means includes first and second light sources, said first light source being energized to indicate a first continuity condition for said electrical circuit and said second light source being energized to indicate a second continuity condition for said electrical circuit.

7. The connector assembly of claim 6 wherein said functional device is a switch operable to connect electrical power to said load, said first light source being energized whenever power is connected to said electrical circuit and said second light source being energized whenever power is applied to the load.

8. The connector assembly of claim 6 wherein said functional device is a monitoring device for indicating a condition of the load, said first light source being energized whenever power is available for said monitoring device, and said second light source being energized whenever power is applied to the load.

9. The connector assembly of claim 6 wherein said first and second light sources comprise first and second neon lamps, respectively, said first neon lamp emitting a light in a first frequency band to illuminate said connector head with a first color and said second neon lamp emitting light in a second frequency band to illuminate said connector head with a second color.

10. A quick-disconnect connector assembly for completing an electrical circuit to connect a functional device to a load and for indicating continuity conditions for the electrical circuit, said connector assembly comprising:

connecting means including an insert carrying a plurality of connector elements;

a multi-conductor cable including at least first, second and third electrical conductors;

indicating circuit means including at least first and second light sources for indicating first and second continuity conditions for the electrical circuit;

at least said first and second conductors being electrically connected to first and second ones of said terminating elements at a first end of said connector body, and said indicating circuit means being electrically connected to and mounted directly on conductors of said multi-conductor cable adjacent to said first end of said connector body to enable said first light source to be energized whenever said first continuity condition is provided and said second light source to be energized whenever said second continuity condition is provided;

and a connector head molded to enclose said first end of said connector body, said indicating circuit means, and the adjacent end of said cable to provide strain relief between said insert and said cable and to provide a sealed housing for said indicating circuit and said connections between said cable and said connector elements of said insert;

said molded connector head being of a light-transmitting material whereby light produced by said first and second light sources causes said molded connector head to emit light representative of the associated continuity conditions whereby the status of said indicating circuit means may be observed from substantially all directions of normal use observation.

11. The connector assembly of claim 10, wherein first and second light sources comprise first and second neon lamps, respectively, said first neon lamp emitting a light in a first frequency band to illuminate said connector head with a first color and said second neon lamp emitting light in a second frequency band to illuminate said connector head with a second color.

12. The connector assembly of claim 10 wherein said connector head is made of a polyvinyl chloride elastomer.

13. A quick-disconnect connector assembly for completing an electrical circuit to connect a functional device to a load and for indicating continuity conditions for the electrical circuit, said connector assembly comprising:

connecting means including an insert carrying a plurality of connector elements;

a multi-conductor cable including at least first and second electrical conductors connected to respective ones of said connector elements of said insert at one end and adapted to be connected to first and second power terminals at the other end and a third electrical conductor connected to a third connector element of said insert at one end and adapted to be connect to a load at the other end;

indicating circuit means including at least first and second light sources for indicating first and second continuity conditions for the electrical circuit;

at least said first and second conductors being electrically connected to first and second ones of said terminating elements at a first end of said connector body, and said indicating circuit means being directly electrically connected to conductors of said multi-conductor cable adjacent to said first end of said connector body to enable said first light source to be energized whenever said first continuity condition is provided and said second light source to be energized whenever said second continuity condition is provided, and the adjacent end of said cable to provide strain relief between said insert and said cable and to provide a sealed housing for said indicating circuit and said connections between said cable and said connector elements of said insert;

a molded connector head enclosing said first end of said connector body and said indicating circuit means, said molded connector head being of a light-transmitting moldable material whereby light produced by said first and second light sources causes said molded connector head to emit light whenever either of said continuity conditions is provided such that the status of said continuity detectors may be observed from substantially all directions of normal use observation.

14. The connector assembly of claim 13, wherein first and second light sources comprise first and second neon lamps, respectively, said first neon lamp emitting a light in a first frequency band to illuminate said connector head with a first color and said second neon lamp emitting light in a second frequency band to illuminate said connector head with a second color.

15. The connector assembly of claim 13 wherein said connector head is made of a polyvinyl chloride elastomer.

* * * * *

UNITED STATES PATENT AND TRADEMARK OFFICE

CERTIFICATE OF CORRECTION

PATENT NO. : 5,244,409

DATED : September 14, 1993

INVENTOR(S) : Robert J. Guss III, John T. Fleckenstein, Ronald J. LeClair

It is certified that error appears in the above-identified patent and that said Letters Patent is hereby corrected as shown below:

Col. 6, line 36, in claim 6, "2" should be --1--.

Signed and Sealed this

Thirty-first Day of May, 1994

Bruce Lehman

*Attest:*

BRUCE LEHMAN

*Attesting Officer*

*Commissioner of Patents and Trademarks*